US005402098A

United States Patent [19]

Ohta et al.

[11] Patent Number: 5,402,098

[45] Date of Patent: Mar. 28, 1995

[54] COIL

[75] Inventors: Hideo Ohta, Nara; Chen W. Ping, Sakai; Sinji Ohki, Matsubara; Yoshiro Morishita, Suita; Teruyoshi Sonoda, Sennan, all of Japan

[73] Assignee: Satosen Co., Ltd., Osaka, Japan

[21] Appl. No.: 855,536

[22] Filed: Mar. 23, 1992

[30] Foreign Application Priority Data

Mar. 25, 1991 [JP] Japan ..... 3-060010
Jul. 29, 1991 [JP] Japan ..... 3-188634

[51] Int. Cl.[6] ..... H01F 5/00
[52] U.S. Cl. ..... 336/200; 336/232
[58] Field of Search ..... 336/200, 232

[56] References Cited

U.S. PATENT DOCUMENTS

| | | | |
|---|---|---|---|
| 3,133,249 | 5/1964 | Parker | 324/150 |
| 4,494,100 | 1/1985 | Stengel et al. | 336/200 |
| 4,543,553 | 9/1985 | Mandai et al. | 336/83 |
| 4,593,245 | 6/1986 | Viertl et al. | 324/238 |
| 5,126,707 | 6/1992 | Ikeda | 333/185 |
| 5,237,165 | 8/1993 | Tingley, III | 336/200 X |
| 5,291,152 | 3/1994 | Seale | 331/65 |

FOREIGN PATENT DOCUMENTS

| | | | |
|---|---|---|---|
| 267108 | 5/1988 | European Pat. Off. | 336/200 |
| 0310396 | 4/1989 | European Pat. Off. . | |
| 1563464 | 5/1970 | Germany . | |
| 2163603 | 2/1986 | United Kingdom . | |
| 2173956 | 10/1986 | United Kingdom . | |

OTHER PUBLICATIONS

JP-A-283 404/1991, filed Mar. 29, 1990 and laid open to public inspection Dec. 13, 1991.

*Primary Examiner*—Leo P. Picard
*Assistant Examiner*—L. Thomas
*Attorney, Agent, or Firm*—Larson and Taylor

[57] ABSTRACT

The invention provides a coil comprising a plurality of stacked coil elements connected together at conductor ends to form at least one series of spiral conductors, the coil being characterized in that each of the coil elements includes a sheet insulator, a first conductor in a planar spiral form and provided on one surface of the insulator and a second conductor in a planar spiral form and provided on the other surface of the insulator, the conductors on the respective surfaces of the insulator being wound spirally in directions opposite to each other when seen from above at the same side of the insulator.

2 Claims, 30 Drawing Sheets

COIL

BACKGROUND OF THE INVENTION

1. Field of the Invention

The present invention relates to coils, and more particularly to coils which are usable as electronic parts, for example, in transformers, noise filters, oscillators, etc. or as circuit components of electronic parts.

2. Description of the Prior Art

Such coils heretofore known comprise a thin conductor which is wound spirally by a machine. The coils known in the art have the problem of being large in height per unit number of turns of conductor. This problem becomes more serious when such coils are mounted on printed circuit boards because they fail to assure the circuit board of a high packing density. Thus, although coils have found wide use as electronic parts, they still remain to be reduced in thickness. Further the conventional construction of coils is not suited to the production of a wide variety of coils in small lots and is liable to permit a break of the conductor or damage to the insulation coating when the conductor is wound. The conventional coils therefore have problems also with respect to reliability and yield.

SUMMARY OF THE INVENTION

An object of the invention is to provide a coil having a reduced thickness and suited to produce in many different types in small lots with improved reliability and in a higher yield.

Another object of the invention is to provide a coil which has a readily controllable number of turns of conductor.

To fulfill the above and other objects, the present invention provides a coil comprising a plurality of stacked coil elements connected together at conductor ends to form at one series of spiral conductors, each of the coil elements including a sheet insulator, a first conductor in a planar spiral form and provided on one surface of the insulator and a second conductor in a planar spiral form and provided on the other surface of the insulator, the conductors on the respective surfaces of the insulator being wound spirally in directions opposite to each other when seen from above at the same side of the insulator.

As another aspect or subject matter of the present invention, the invention provides a coil comprising at least one coil element, the coil element including a sheet insulator, and a first conductor and a second conductor provided on the insulator and each in a planar spiral form. The first conductor and the second conductor are provided on one surface of the sheet insulator, with one of the conductors extending between the turns of the other conductor. Alternatively, the first conductor is provided on one surface of the sheet insulator, and the second conductor is disposed on the other surface of the insulator. In either case, the first and second conductors form separate circuits.

As another aspect or subject matter of the present invention, the invention provides a coil comprising stacked coil elements of two different types selected from a first-type coil element, a second-type coil element, a third-type coil element and a fourth-type coil element, the first-type coil element comprising a first conductor and a second conductor provided on at least one surface of a sheet insulator and each in a planar spiral form, one of the first and second conductors extending between turns of the other conductor, the second-type coil element comprising a first conductor and a second conductor provided on at least one surface of a sheet insulator and each in a planar spiral form, one of the first and second conductors of the second-type coil element extending between turns of the other conductor, the conductors of the second-type coil element being spirally wound in one direction opposite to the winding direction of the conductors of the first-type coil element when seen from above at the same side of the insulators, the third-type coil element comprising a conductor in a planar spiral form and provided on a surface of a sheet insulator, the fourth-type coil element comprising a planar spiral conductor provided on a surface of a sheet insulator and spirally wound in a direction opposite to the winding direction of the conductor of the third-type coil element when seen from above at the same side of the insulators of the third and fourth coil elements. The coil has two series of spiral conductors, a plurality of circuits or at least one series circuit formed by the coil elements of two different types.

In connection with insulators, the term "surface" is used herein and in the appended claims in a broad sense including a "surface of an inner layer of insulators comprising a plurality of layers."

According to the invention, the winding direction of spiral conductors on the front or rear surface of a particular insulator is specified to form a required number of desired series circuits of spiral conductors by coil elements of the invention.

The coil element of the invention comprises an insulator in the form of a sheet, and at least one conductor in a planar spiral form and provided on one or each surface of the insulator, and is in the form of a sheet in its entirety. Thus, the coil element will sometimes be referred to as a "coil sheet." A plurality of such coil elements can be assembled or arranged in layers to form at least one series of spiral conductors or two-terminal series circuit. According to the invention, therefore, the assembly of coil elements can be reduced in height, i.e., in thickness, per unit number of turns of conductor. Therefore, the two-terminal series circuit can be provided by a desired number of turns of conductors using a selected number of coil elements having the same number of turns. The coil element or coil sheet can be prepared by the same method as printed circuit boards, so that coil sheets which are different in the number of turns can be produced readily.

When the coil sheet has a spiral conductor on each of its front and rear surfaces, these conductors are spirally wound in directions opposite to each other when seen from above at the same side of the sheet. This means that a plurality of coil sheets can be made identical in circuit pattern except the external or internal connection of the conductor ends. The connections for the ends of front and rear conductors of coil sheets can also be standardized. For example, the connections for the conductor inner ends can be established via through holes in the sheets which holes are positioned in phase. The interconnections between conductor ends corresponding to intermediate terminals of the two-terminal series circuit can also be standardized. For example, conductor outer ends can be interconnected by pads which are positioned in phase. The external terminal of the circuit, for example, the outer end of the outermost conductor, may be connected to a through hole terminal.

Thus according to the present invention, all the coil sheets to be used can be standardized almost entirely to the same circuit pattern. For example, in the case where coil sheets of the invention are used for the windings of transformers, the use of the coil sheets results in the following advantage as will be described later. When having one primary winding and one secondary winding, the transformer can be fabricated using two kinds of coil sheets which are different in circuit pattern. When having two primary or secondary windings and one winding of the other type, the transformer can be obtained using coil sheets of three different circuit patterns, or of two different circuit patterns depending on the position of through holes.

As will be apparent from "the foregoing description" the present invention is suited to the production of many different types of coils in small lots.

According to the invention, coils can be fabricated in the same manner as the circuit pattern of printed circuit board, and the conductor need not be coiled in the conventional manner. For this reason, coils can be produced with improved reliability in a high yield without the likelihood of a break in the conductor or damage to the insulation coating.

The desired product or assembly of coils can be made to have a readily controlled number of turns of conductors by preparing coil sheets having the same number of turns and varying the number of such coil sheet to be used. This ensures a great advantage when coil sheets of the invention are used for fabricating transformers or like devices having two types of windings.

Further the construction of the coil of the present invention is usable for the transmission of data in an insulated state in place of the wiring between a computer and a keyboard or the wiring between primary substrates.

When it is desired to further reduce the thickness of the coil of the invention relative to the unit number of turns of conductor, that is, to make the coil more planar, the sheet insulator may be internally provided with a spiral conductor like the one provided on the outer surface thereof.

BRIEF DESCRIPTION OF THE DRAWINGS

FIGS. 12, 13 and 14 are a perspective view of the first modification, a circuit diagram of the upper side of a coil element and a circuit diagram of the lower side of the coil element, respectively;

FIGS. 15, 16 and 17 are a perspective view of the second modification, a front circuit pattern diagram of a coil element and a rear circuit pattern diagram of the coil element, respectively;

FIGS. 18, 19, 20 and 21 are a perspective view of the third modification, a circuit diagram of an upper-layer coil element, a circuit diagram of an intermediate-layer coil element and a circuit diagram of a lower-layer coil element, respectively;

FIGS. 22, 23 and 24 are a circuit diagram of an upper-layer coil element of the fourth modification, a circuit diagram of an intermediate-layer coil element of the same and a circuit diagram of a lower-layer coil element of the same, respectively;

FIGS. 25, 26 and 27 are a circuit diagram of an upper-layer coil element of the fifth modification, a circuit diagram of an intermediate-layer coil element thereof and a circuit diagram of a lower-layer coil element thereof, respectively;

FIGS. 28, 29, 30 and 31 are a perspective view of the sixth modification, a circuit diagram of an upper-layer coil element thereof, a circuit diagram of an intermediate-layer coil element thereof and a circuit diagram of a lower-layer coil element thereof, respectively; and FIGS. 32, 33, 34 and 35 are a perspective view of the seventh modification, a circuit diagram of an upper-layer coil element thereof, a circuit diagram of an intermediate-layer coil element thereof and a circuit diagram of a lower-layer coil element thereof.

DESCRIPTION OF THE PREFERRED EMBODIMENTS

With reference to the drawings, indicated at 1 are coil elements or coil sheets. In the embodiment shown in FIG. 1–10, the coil sheet 1 comprises an insulator 2 in the form of a sheet, and a first conductor 3-1 and a second conductor 3-2 which are provided on the front surface and the rear surface of the insulator 2, respectively, and each of which is in a planar spiral form. The conductors 3 on the respective surfaces are wound spirally in directions opposite to each other when seen from above at the same side of the insulator 2. In each of FIGS. 1–7 and 10, the coil on the front surface of each coil sheet is shown in solid line and the coil on the rear surface of each coil sheet is shown in dashed line. In FIGS. 1–10, winding direction is shown by arrow, solid line arrows indicating the winding direction of the spiral coil on the front surface of each coil sheet and dashed line arrows indicating the winding direction of the spiral coil on the rear surface of each coil sheet.

Figure 1:
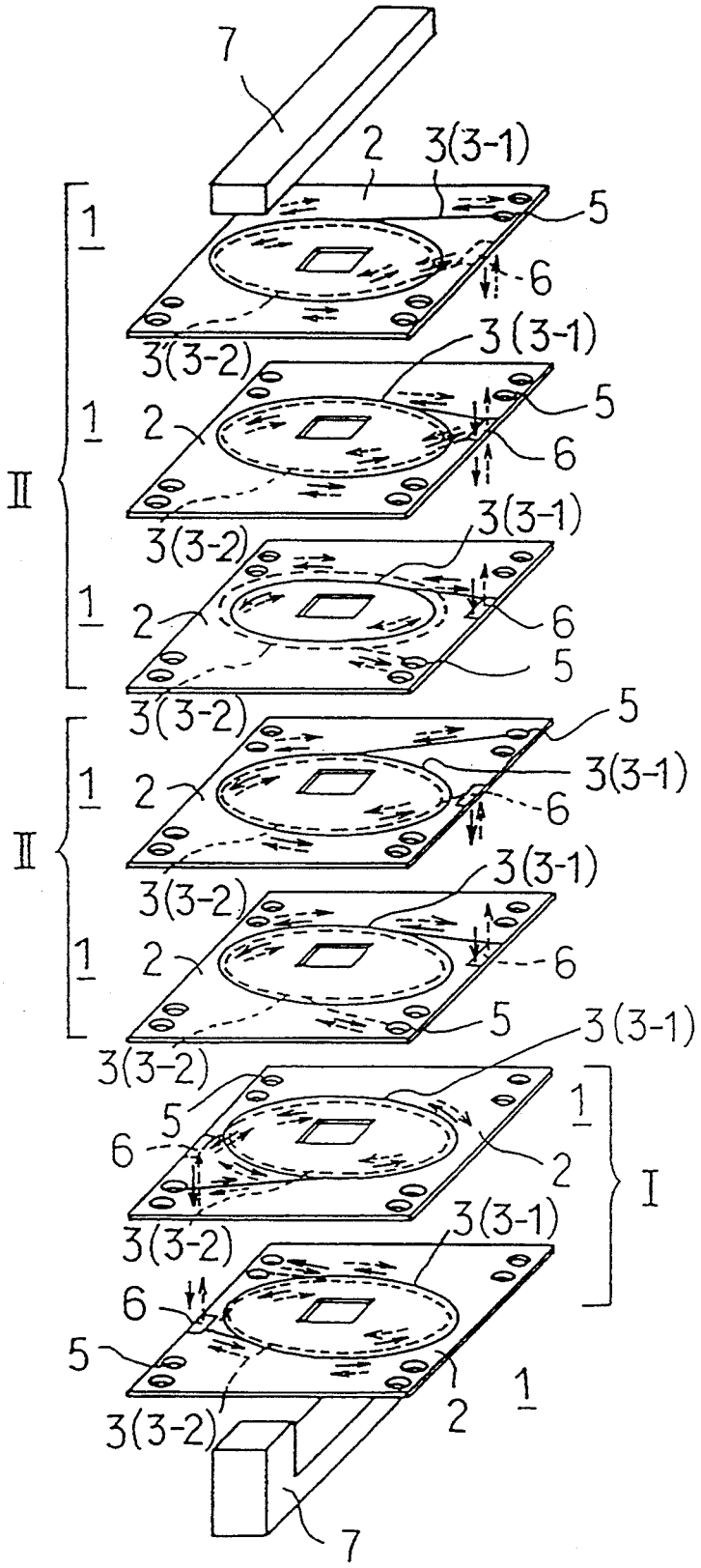
FIG. 1 is a perspective view of an embodiment of the invention comprising coil elements which are shown as separated from one another.

The embodiment shown in FIG. 1 includes a plurality of coil sheets 1 which are in the form of an assembly comprising a two-terminal series circuit serving as a primary winding I, and two two-terminal series circuits serving as secondary windings II. Each of the two-terminal series circuits comprises two or three coil sheets 1 which are stacked up in layers. The front and rear spiral conductors 3 of each coil sheet 1 of each series circuit have inner ends which are connected together at a plated through hole 4 (FIG. 8) in the center of the sheet. When serving as an external terminal of the series circuit, the other end, i.e., outer end, of each conductor 3 is connected to the plating of a plated through hole 5 formed at a corner of the coil sheet 1 as a terminal. Alternatively when serving as an intermediate terminal of the circuit, the outer end of each conductor 3 is connected to a pad 6 formed on a required portion of the coil sheet 1. The pads 6 of the adjacent coil sheets 1 in each series circuit are joined to each other.

Figure 11:
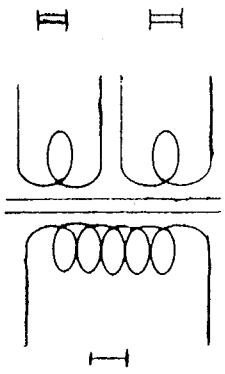
FIG. 11 is a symbolic diagram of the embodiment shown in FIG. 1, i.e., a transformer.

The embodiment of FIG. 1 comprises one primary winding I and two secondary windings II and is symbolically shown in FIG. 11. The two secondary windings II are each in the form of a series circuit formed by two or three coil sheets 1 which are connected together in series. The conductor ends corresponding to the external terminals of the series circuit are connected to the platings of the respective plated through holes 5 in corners of the corresponding coil sheets 1 which corners are different in position. The two series circuits, i.e., the two secondary windings II, are also different in the position of the through holes 5 at which each of such external conductor ends is located.

Figure 2:
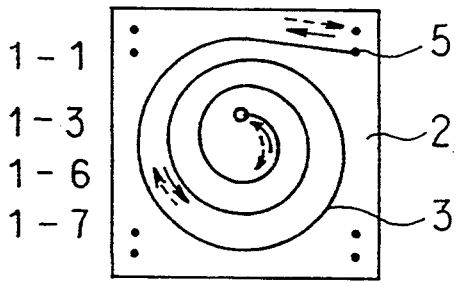
FIGS. 2 to 7 are diagrams of spiral patterns of the coil sheets shown in FIG. 1 on the front or rear surface of each sheet, the diagrams of the rear spiral patterns (FIGS. 3, 5 and 7) being shown as they would appear if looking downward from above the front surface.
Figure 3:
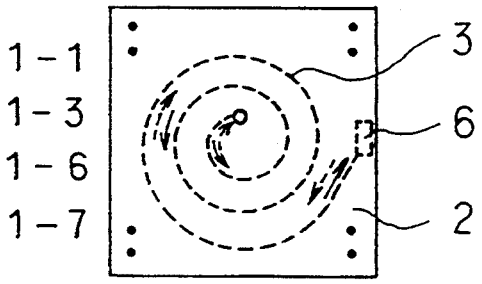
Figure 4:
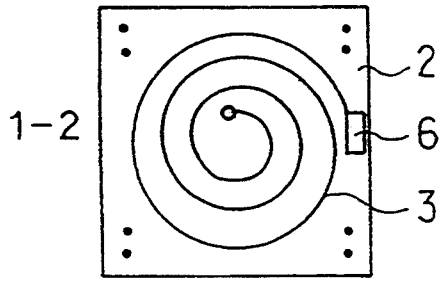
Figure 5:
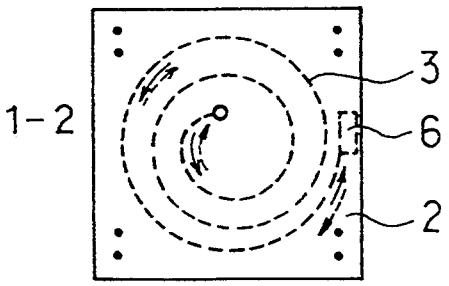
Figure 6:
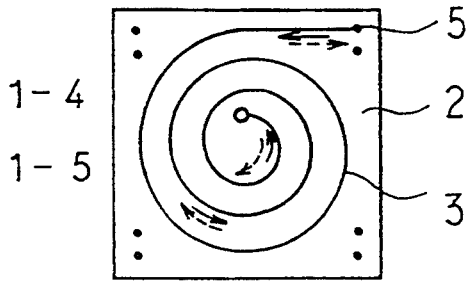
Figure 7:
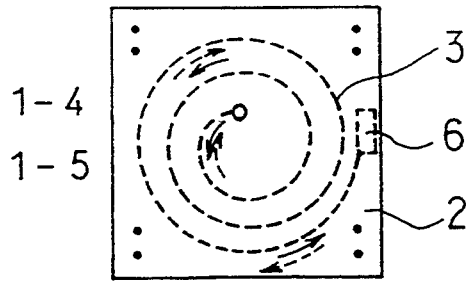
Figure 8:
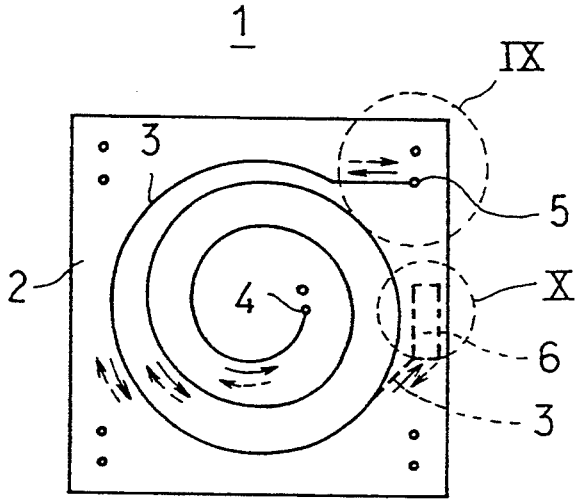
FIG. 8 is a detailed plan view of one of the coil sheets.
Figure 9:
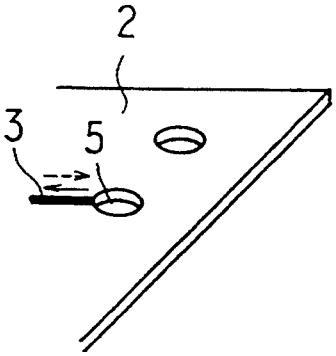
FIG. 9 is an enlarged perspective view of the portion IX of FIG. 8.
Figure 10:
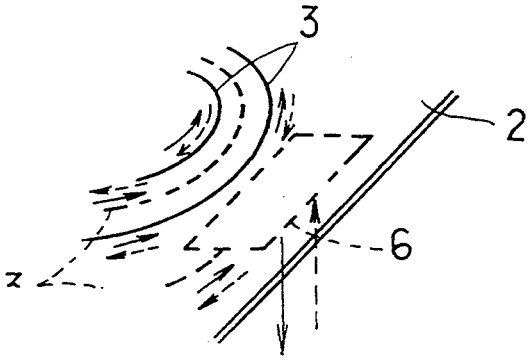
FIG. 10 is an enlarged perspective view of the portion X of FIG. 8.

With the embodiment of FIG. 1, seven coil sheets 1 are used to form the specified number of two-terminal series circuits. The front and rear circuit patterns of these seven coil sheets 1 can be those shown in FIGS. 2 to 7. With reference to FIGS. 2 to 7, the first to seventh coil sheets as arranged from above downward in FIG. 1 are indicated at 1-1, 1-2, 1-3, 1-4, 1-5, 1-6 and 1-7, respectively. FIGS. 2, 4 and 6 show the front circuit patterns, and FIGS. 3, 5 and 7 show the rear circuit patterns as seen from the front side of the coil sheet 1.

FIGS. 1 to 7 reveal that in the case where the assembly of one primary winding and two secondary windings are formed by seven coil sheets, the first, third, sixth and seventh coil sheets, as well as the fourth and fifth coil sheets, can be identical in circuit pattern inclusive of the intermediate and external terminal connections of each series circuit. Thus, the whole assembly can be formed by coil sheets of three different circuit patterns. (However, the third and seventh coil sheets are identical with the first coil sheet as turned upside down, and the fifth coil sheet with the fourth coil sheet as turned upside down.) Depending on the arrangement of through holes selected for use, the coil sheets to be used can be of two kinds of circuit patterns. An assembly comprising one primary winding and one secondary winding can be formed by coil sheets of two different circuit patterns.

The coil sheets 1 are arranged in layers to form the specified two-terminal series circuits and mounted on a ferrite or like core 7 to make a transformer. In such case, the coil sheets 1 comprise insulators 2 having holes through which the legs of the core 7 are inserted.

Figure 12:
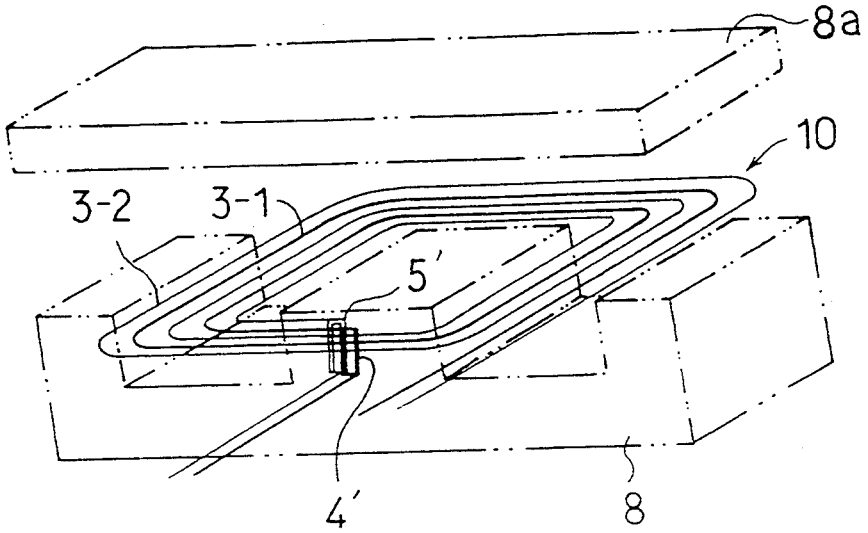
FIGS. 12 to 14, FIGS. 15 to 17, FIGS. 18 to 21, FIGS. 22 to 24, FIGS. 25 to 27, FIGS. 28 30, 31, and FIGS. 32 to 35 show first to seventh modified embodiments of the invention, respectively.

The coil of the invention can be mounted between a printed circuit board and another printed circuit board. This type of embodiment is the same as the embodiment of FIG. 36 to be described later in respect of the other type of coil sheet according to this invention as shown in FIG. 12 et. seq.

An embodiment of the invention was tested as described in the following test example.

TEST EXAMPLE

Three kinds of coil sheets, different in circuit pattern, were prepared which had 6 turns of a conductor on each surface, i.e., 12 turns on both surfaces combined. Two of the coil sheets were arranged in parallel to form primary windings, and eleven of the sheets were electrically connected together in series to form a secondary winding of 132 turns in total. The assembly was then held between ferrite core members to make a transformer. When a d.c. voltage of 12 V was applied to the two primary windings alternately, the secondary winding delivered an a.c. voltage of 100 V, which was applied to an ultrasonic motor as a power supply. The transformer was found operable free of problems such as heat generation.

Figure 13:
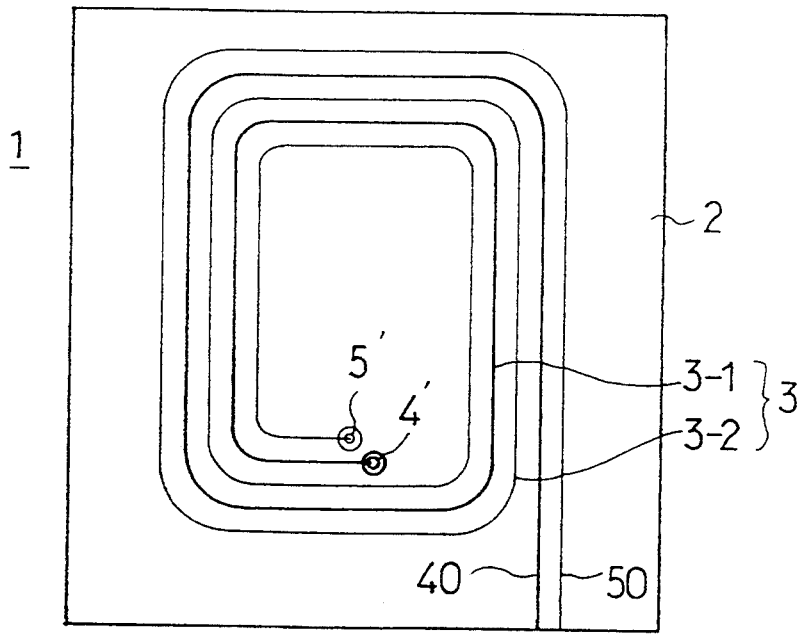
Figure 14:
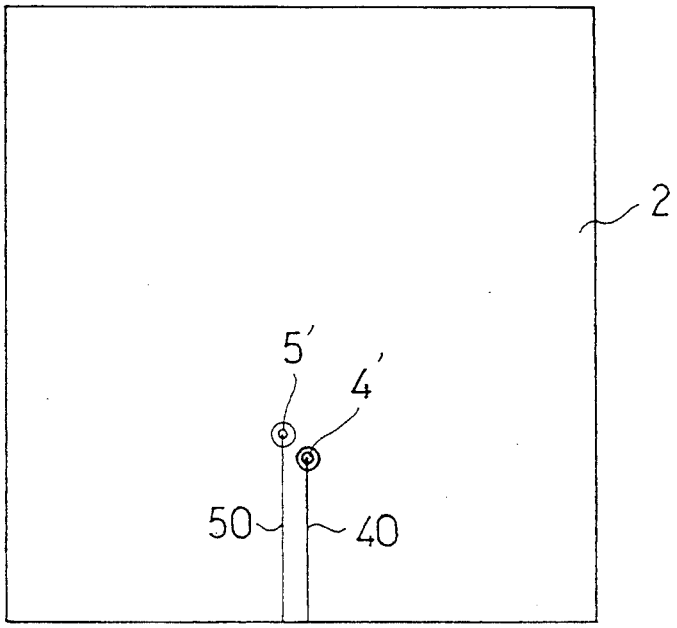

FIGS. 12, 13 and 14 show an embodiment wherein a coil sheet 1 comprises a first conductor 3-1 and a second conductor 3-2 which are wound spirally on the front surface of an insulator 2 in the form of a sheet and each form a two-terminal circuit. One of the conductors extends between the turns of the other conductor. The inner ends of the first and second conductors 3-1 and 3-2 are connected by the platings of plated through holes 4' and 5' to external conduction lines 40 and 50 (FIG. 14) on the rear surface of the coil sheet 1, respectively. The outer ends of the conductors extend into external conduction lines 40, 50 on the front surface of the coil sheet 1, respectively. The circuit assembly of the first and second conductors 3-1, 3-2 is shown in FIG. 12 with the insulator 2 omitted. The external conduction lines 40, 50 on the rear surface are shown as they are seen from the front side of the coil sheet 1. The first and second conductors 3-1, 3-2 are represented by a thick line and a thin line, respectively, for clarity as is the case with the following embodiments. The embodiment of FIGS. 12, 13 and 14 comprises coil elements which are not connected in series, that is, the first and second conductors 3-1, 3-2 form separate circuits.

When the conductors 3-1, 3-2 each singly serve as a coil element, one of these conductors can be provided on one surface of the coil sheet 1, with the other conductor provided on the other surface thereof. FIG. 13 shows the combined pattern of the first and second conductors according to this modification and also shows the circuit pattern on the front surface of the embodiment of FIG. 12.

Figure 15:
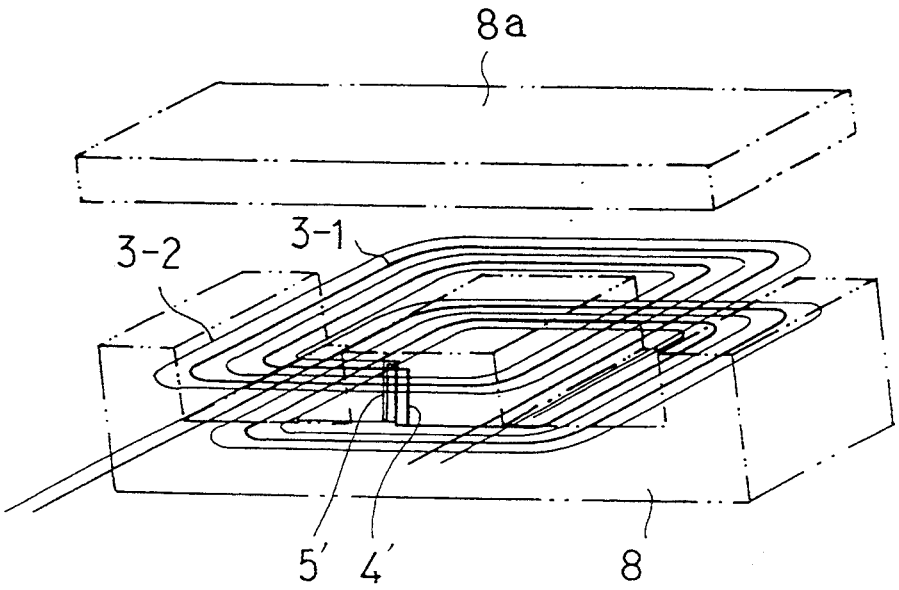
Figure 16:
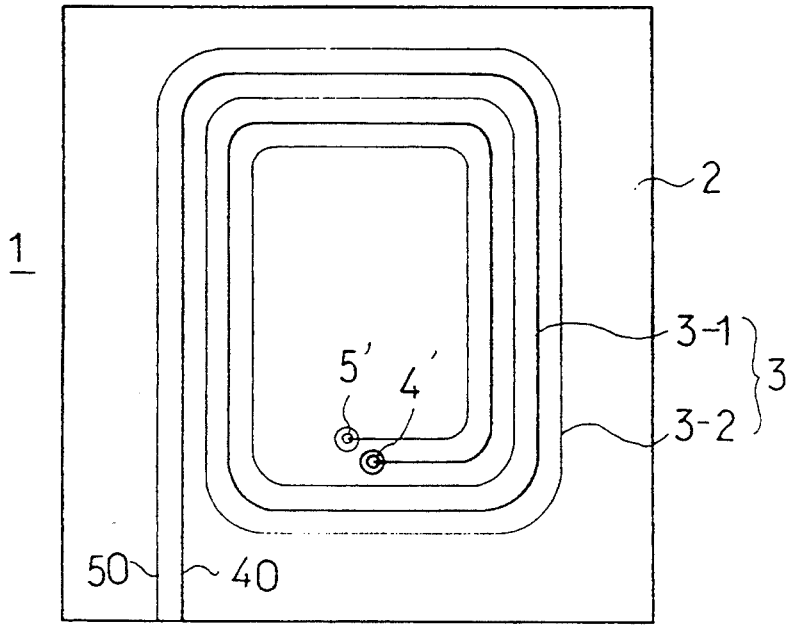
Figure 17:
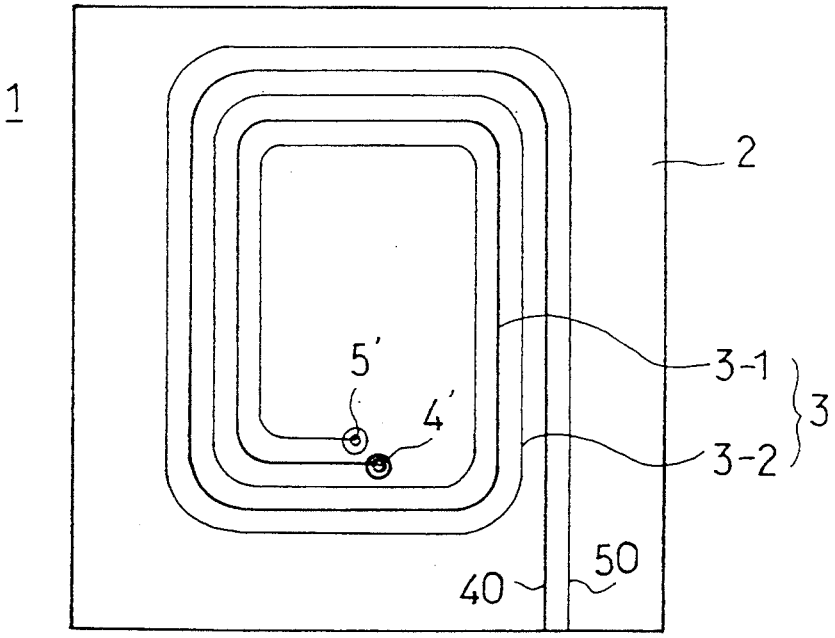

FIGS. 15, 16 and 17 show another embodiment comprising a first-type coil sheet 1 (FIG. 16) and a second-type coil sheet 1 (FIG. 17) in combination. The first-type coil sheet 1 comprises a first conductor 3-1 and a second conductor 3-2 which are spirally wound on the front surface of a sheet insulator 2 and one of which extends between the turns of the other conductor. The second-type coil sheet 1 comprises first and second conductors and has substantially the same construction as the first-type coil sheet except that these conductors are spirally wound in a direction opposite to the direction of winding of the conductors on the first-type coil sheet. The coil sheets of the two types may be so formed that the single sheet insulator 2 having the first and second conductors 3-1, 3-2 of one type on one surface thereof is provided on the other surface thereof with the first and second conductors 3-1, 3-2 of the other type. Alternatively, the two sheet insulators 2 each provided with the first and second conductors 3-1, 3-2 on one surface thereof as specified may be superposed. In the latter case, the first and second conductors 3-1, 3-2 on each of the upper and lower sheet insulators 2 may be positioned on an outer surface or inside the assembly.

With reference to the embodiment of FIGS. 15, 16 and 17, the inner ends of the first and second conductors 3-1, 3-2 on the front side are connected by the platings of plated through holes 4', 5' to the inner ends of the first and second conductors 3-1, 3-2 on the rear side, respectively. The outer ends of the conductors on each side extend into external conduction lines 40, 50 on the same side. The overall circuit construction of the four first and second conductors 3-1, 3-2 is shown in FIG. 15 in the same manner as in FIG. 12. The first and second conductors on the rear side (FIG. 17) are shown as they are seen from the front side of the coil sheet 1.

As will be apparent from the above description, the two first conductors 3-1, as well as the two second conductors 3-2, of the embodiment of FIGS. 15 to 17 form a two-terminal series circuit.

Such coil sheets are assembled or stacked up to provide specified circuits.

FIGS. 18, 19, 20 and 21 show an embodiment comprising two types of coil sheets in combination, i.e., a third-type coil sheet 1 (FIG. 19) having a planar spiral conductor 3 formed on the front surface of a sheet insulator 2, and a fourth-type coil sheet 1 (FIG. 21) having substantially the same construction as the third-type coil sheet except that the conductor is spirally wound in a direction opposite to the winding direction of the conductor of the third-type coil sheet when seen from above at the same side of the insulators 2.

Figure 18:
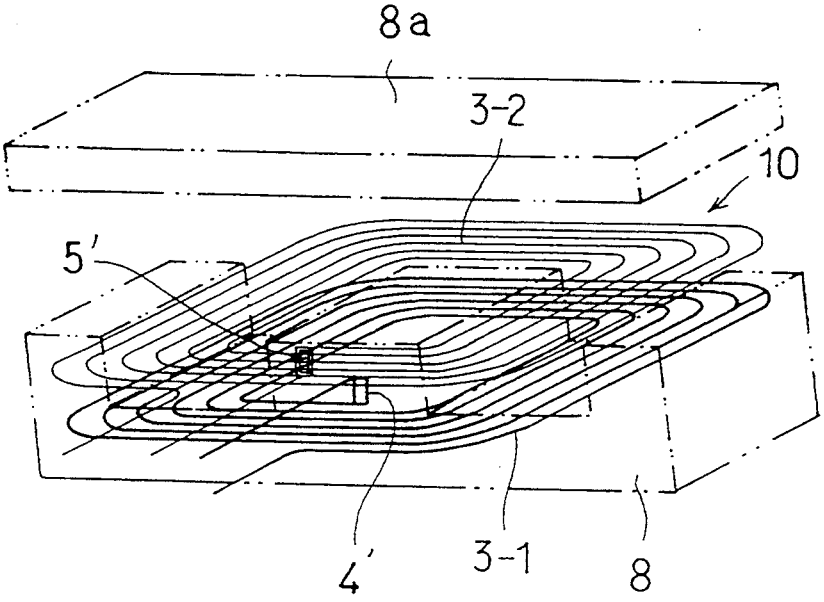
Figure 19:
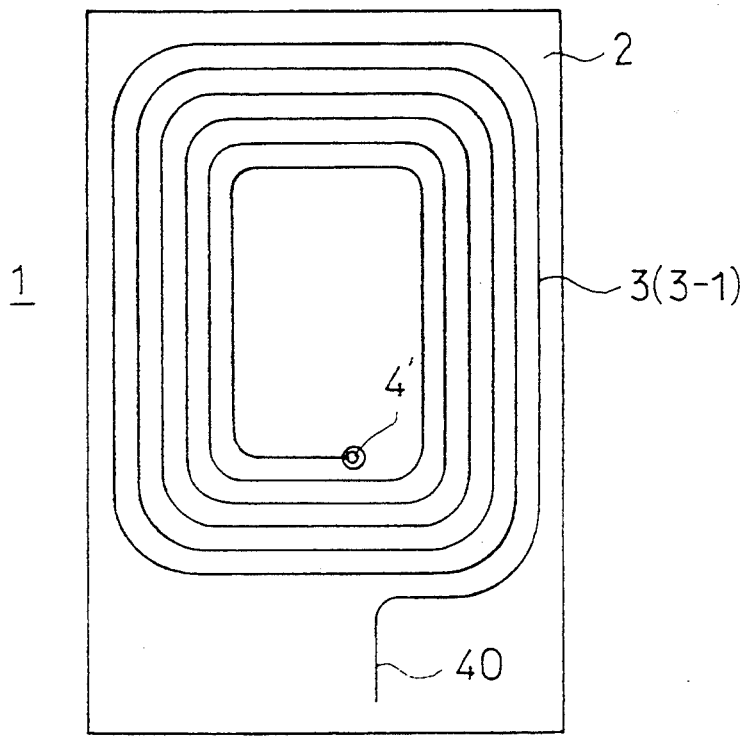
Figure 20:
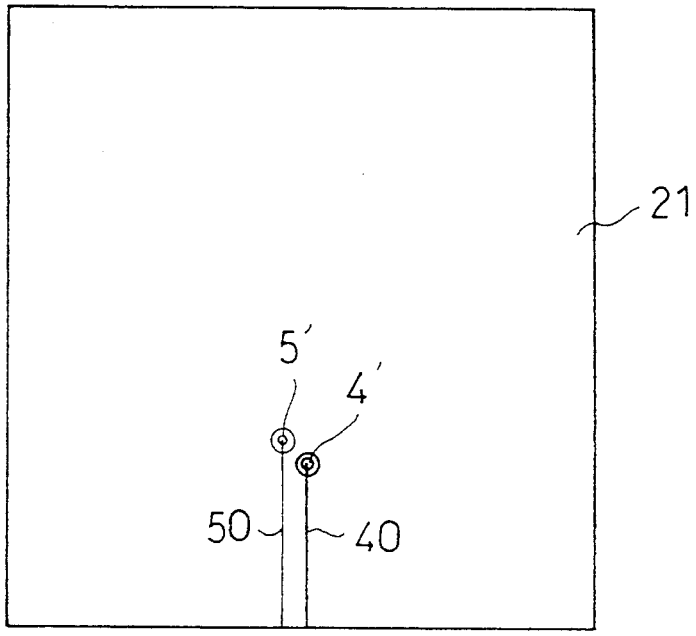
Figure 21:
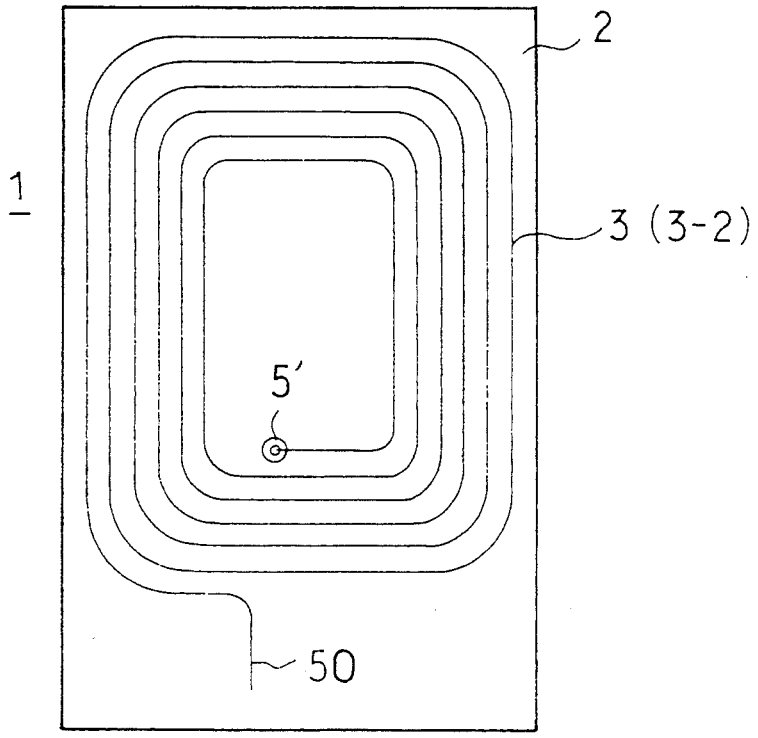

The embodiment of FIGS. 18 to 21 has a three-layer construction wherein the coil sheet 1 (FIG. 19) of one of the third and fourth types is the upper-layer, a sheet insulator 21 (FIG. 20) having external conduction lines 40, 50 on its front surface is the intermediate layer, and the coil sheet 1 (FIG. 21) of the other type is the lower layer. The inner end of the conductor 3 of the upper coil sheet 1 is connected by the plating of a plated through hole 4' to the external conduction line 40 on the sheet insulator 21 as the intermediate layer, and the outer end thereof is connected to an external conduction line on the upper layer. The inner end of the conductor 3 of the lower coil sheet 1 is connected by the plating of a plated through hole 5' to the external conduction line 50 on the sheet insulator 21 as the intermediate layer, and the outer end thereof extends into an external conduction line on the lower layer. The overall circuit construction of these coil sheets is shown in FIG. 18 in the same manner as the foregoing embodiments. The conduction lines 40, 50 on the intermediate layer and the conductors 3 on the lower layer are illustrated as they are seen from the front side of the upper layer.

As will be apparent from the above description, the conductor 3 of one of the two coil sheets 1 of the embodiment shown in FIGS. 18 to 21 corresponds to the first conductor 3-1 of the embodiments of FIGS. 12 to 17, and the conductor 3 of the other coil sheet to the second conductor 3-2 thereof. Each of these conductors provides a two terminal circuit.

Such coil sheets of the embodiment of FIGS.18 to 21 are assembled or stacked up to form specified circuits.

Figure 22:
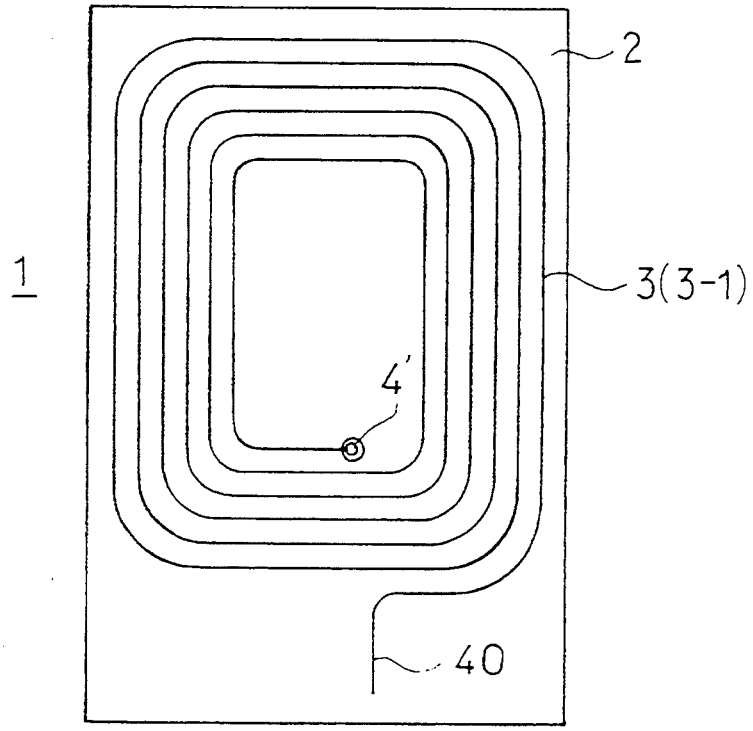
Figure 23:
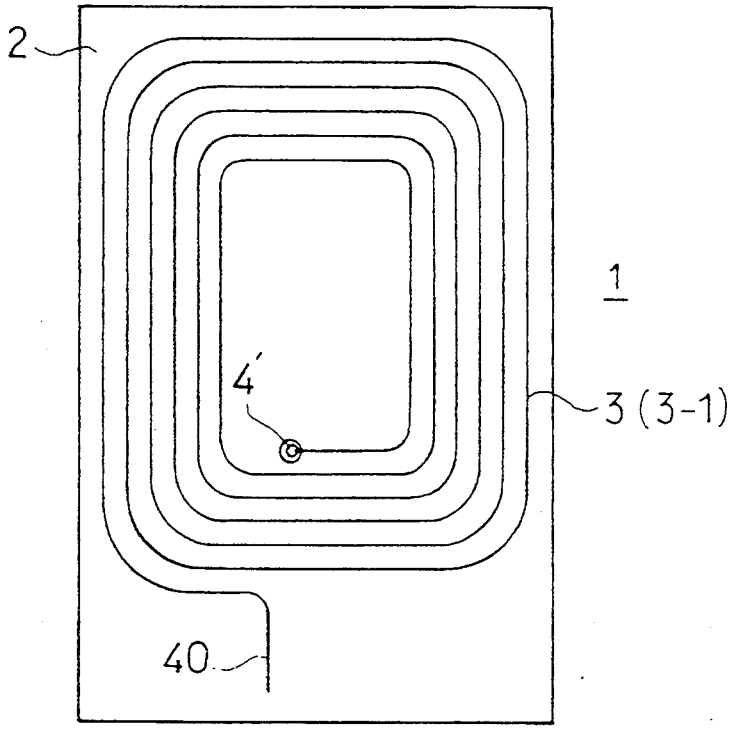
Figure 24:
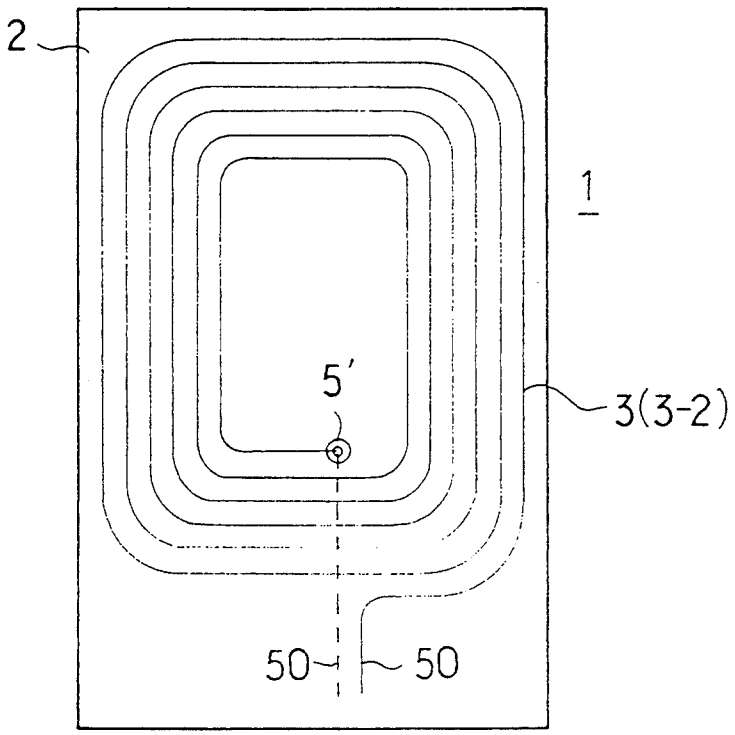

FIGS. 22, 23 and 24 show an embodiment of modified, three-layer construction. With this embodiment, an upper-layer coil sheet 1 (FIG. 22) and an intermediate-layer coil sheet 1 (FIG. 23) each comprise a planar spiral conductor 3 on a sheet insulator 2 and have substantially the same construction except that the conductors 3 on these sheets 1 are spirally wound in directions opposite to each other when seen from above at the same side of the insulators 2. A lower-layer coil sheet 1 (FIG. 24) is substantially the same as the upper-layer coil sheet 1. The coil sheets of the upper and lower layers are those of the third type, while the intermediate-layer coil sheet is of the fourth type. The inner end of the conductor 3 of the upper-layer coil sheet 1 is connected by the plating of a plated through hole 4' to the inner end of the conductor 3 of the intermediate-layer coil sheet, and the outer ends of these conductors 3 are each connected to an external conduction line 40 on the surface of the corresponding layer. The inner end of the conductor 3 of the lower-layer coil sheet 1 is connected by the plating of a plated through hole 5' to an external conduction line 50 on the surface of the insulator 2 of the same sheet opposite to the conductor-bearing surface thereof. The outer end of the same conductor 3 extends into an external conduction line 50 on the latter surface. The conductors of the intermediate and lower layers are shown as they are seen from the front side of the upper layer. The external conduction line of the conductor inner end of the lower-layer coil sheet 1 shown in FIG. 24 and the external conduction line of the conductor outer end thereof are arranged on the respective different surfaces of the insulator 2 as stated above, while this lower-layer coil sheet is shown as seen from the front side of the upper layer, so that the external conduction line of the conductor inner end is indicated in a broken line for clarity.

With the embodiment of FIGS. 22, 23 and 24, the conductors 3 of the upper and intermediate layers correspond to the aforementioned first conductor 3-1, and the conductor 3 of the lower layer to the second conductor 3-2. The former two conductors 3 form a two-terminal series circuit, and the other conductor forms a two-terminal circuit. The embodiment of this type is also an example of combination of two types, i.e., the third-type coil sheet and the fourth-type coil sheet.

Such coil sheets of the embodiment of FIGS. 22, 23 and 24 are assembled or stacked up to form specified circuits.

Figure 25:
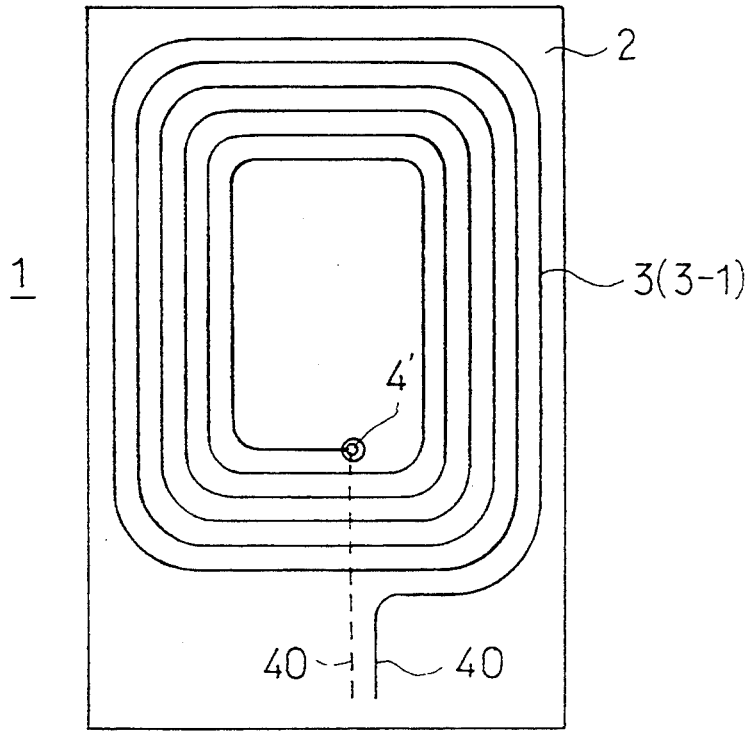
Figure 26:
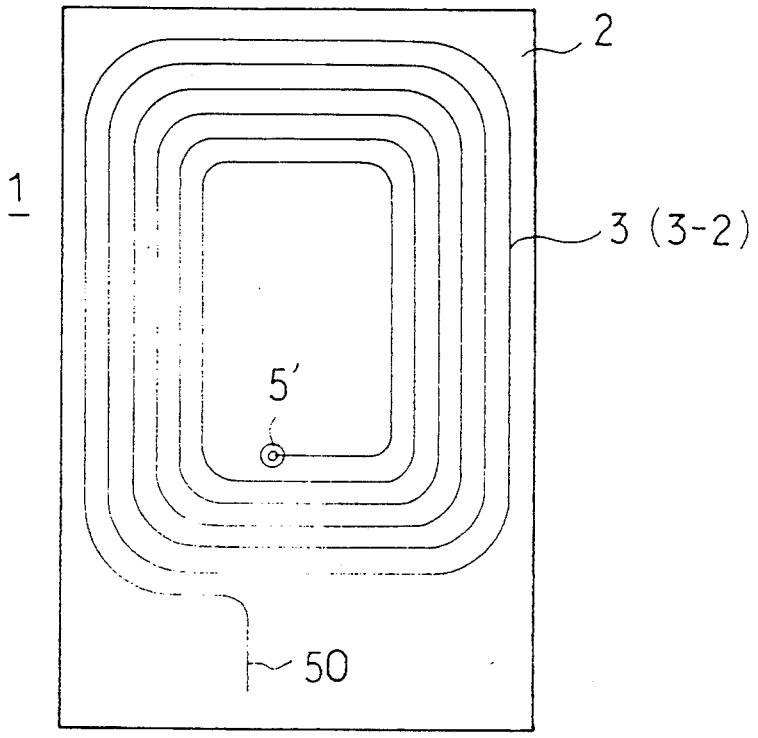
Figure 27:
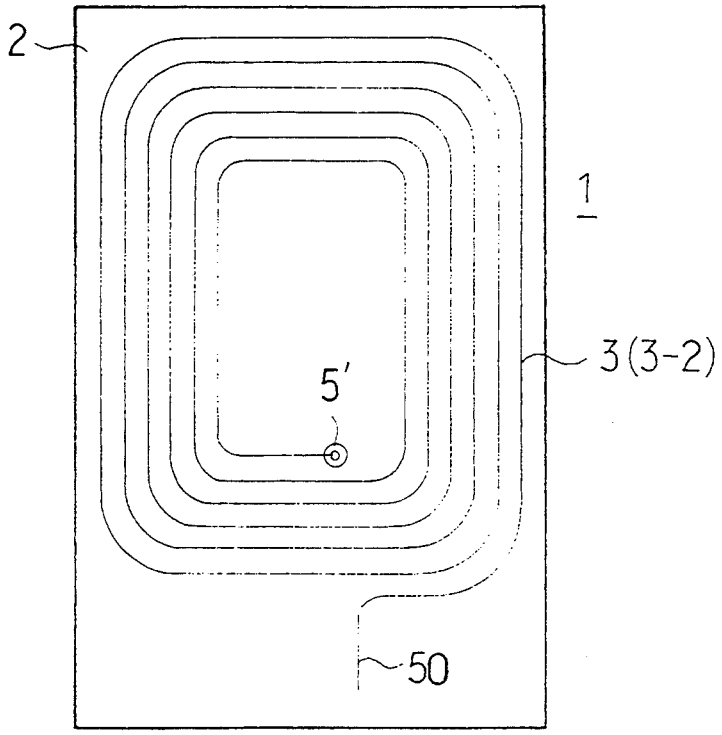

FIGS. 25, 26 and 27 show another modification of three-layer construction. With this modification, an upper-layer coil sheet 1 (FIG. 25) forms a two-terminal circuit, and intermediate-layer and lower-layer coil sheets 1 (FIGS. 26 and 27) provide a two-terminal series circuit. External conduction lines 40 and 50 are so arranged as to form these circuits. With the exception of this feature, the modification has substantially the same construction as the modified embodiment of FIGS. 22 to 24. The conductor 3 of the upper-layer coil sheet 1 corresponds to the first conductor 3-1, and the conductors 3 of the intermediate-layer and lower-layer coil sheets 1 correspond to the second conductor 3-2. The external conduction line of the conductor inner end of the upper-layer coil sheet 1 is indicated in a broken line as in FIG. 24. The upper-layer and lower-layer coil sheets are those of the third type, and the intermediate layer coil sheet is of the fourth type.

Such coil sheets of the modification of FIGS. 25 to 27 are assembled or stacked up to form specified circuits.

Figure 28:
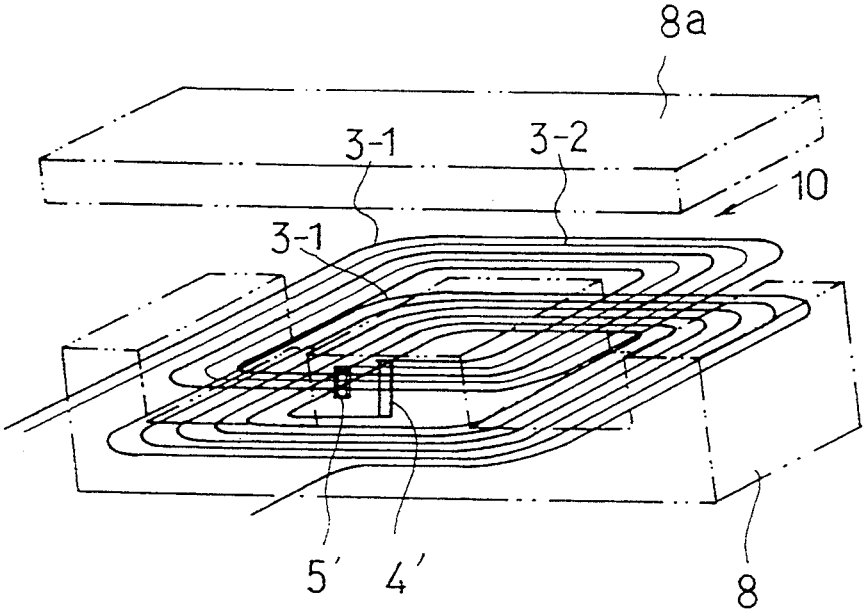
Figure 29:
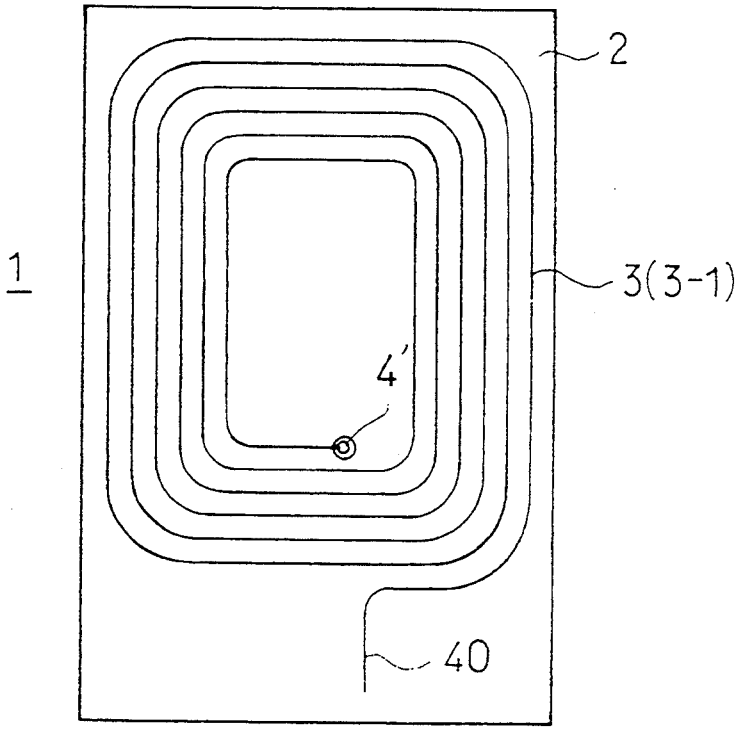
Figure 30:
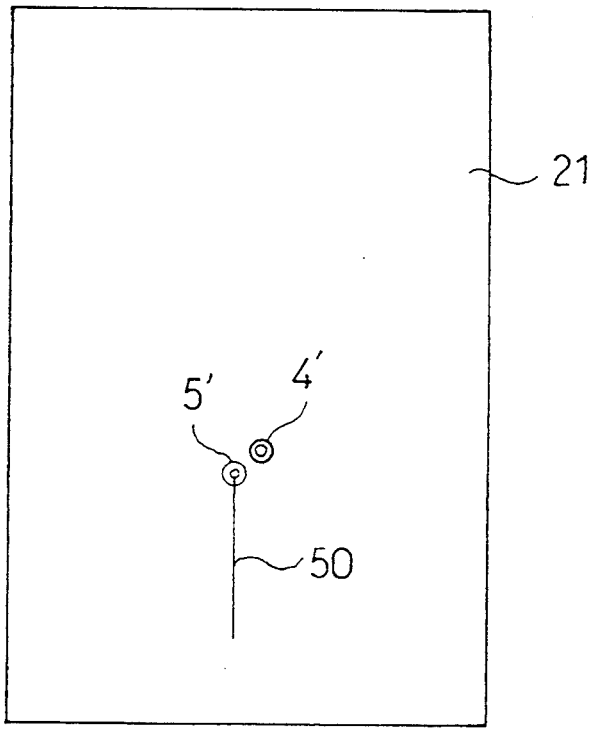
Figure 31:
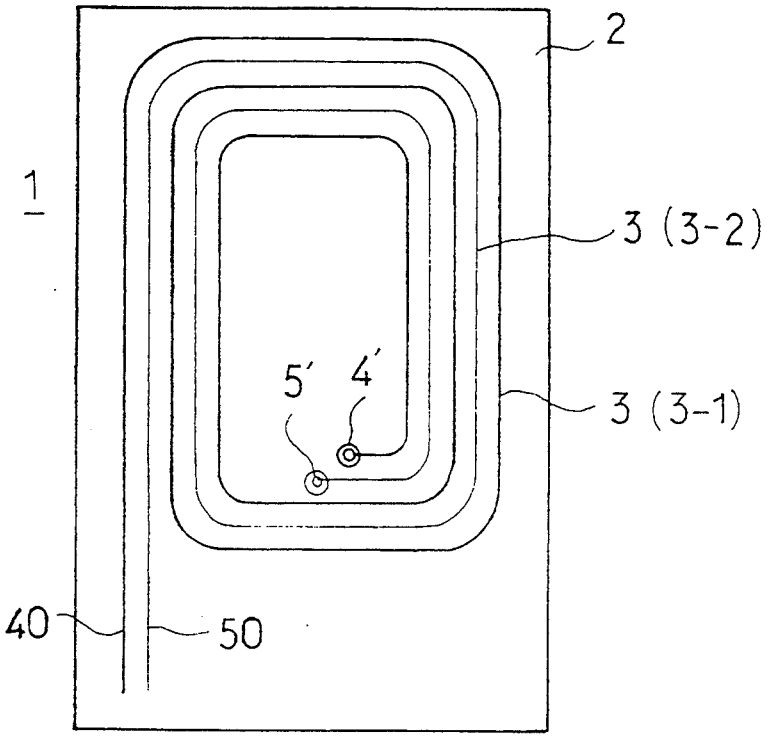

FIGS. 28, 29, 30 and 31 show another modification of three-layer construction. This modification comprises an upper layer which is a coil sheet 1 (FIG. 29) having a conductor 3 corresponding to the first conductor 3-1, an intermediate layer which is a sheet insulator 21 (FIG. 30) having an external conduction line 50, and a lower layer which is a coil sheet 1 (FIG. 31) having first and second conductors 3-1, 3-2 spirally wound in a direction opposite to the winding direction of the conductor of the upper layer when seen from above at the same side of insulators. The coil sheets are stacked up. The conductor 3 of the upper-layer and the first conductor 3-1 of the lower layer form a two-terminal series circuit, and the second conductor 3-2 of the lower-layer provides a two-terminal circuit. The upper-layer coil sheet is of the third type, while the lower-layer coil sheet is of the first type. The inner end of the conductor 3 of the upper layer is connected to the inner end of the conductor 3-1 of the lower layer via a plated through hole 4' of the insulator 21 and a plated through hole 4' of the lower layer. The outer end of the same conductor extends into an external conduction line 40 on the upper layer. The inner end of the second conductor 3-2 of the lower layer is connected to an external conduction line 50 on the insulator 21 via a plated through hole in the insulator 21. The outer ends of the first and second conductors 3-1, 3-2 of the lower layer extend into external conduction lines 40, 50 on the same layer. The external conduction line of the intermediate layer and the conductors of the lower layer are shown in the same manner as above. The overall circuit construction of conductors of the layers is shown in FIG. 28 in the same manner as already stated.

Such coil sheets of the modification of FIGS. 28 to 31 are assembled or stacked up to form specified circuits.

Figure 32:
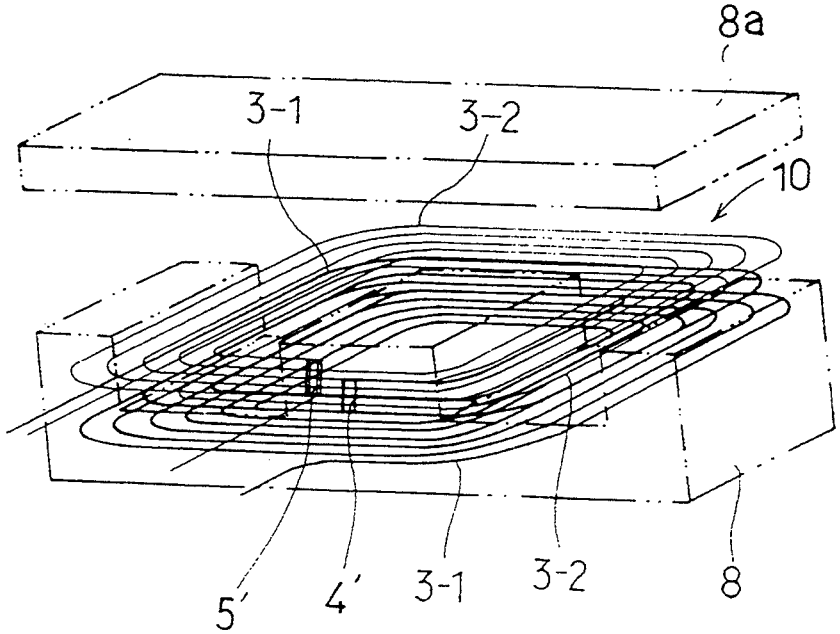
Figure 33:
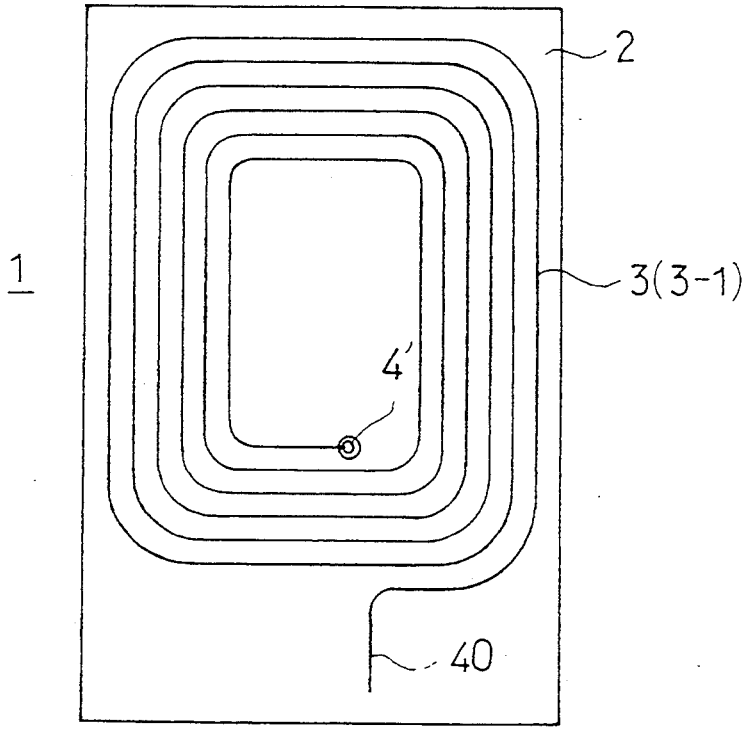
Figure 34:
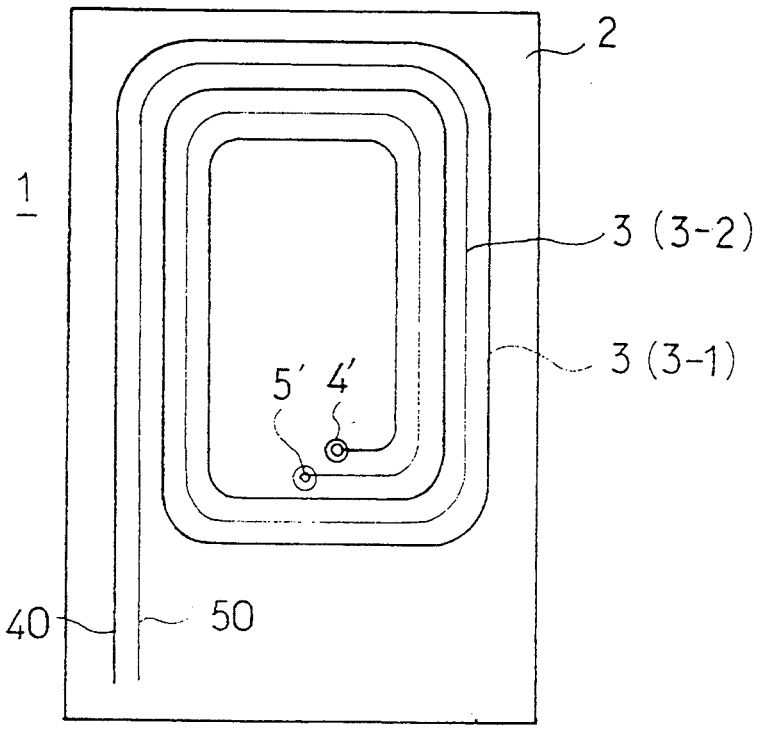
Figure 35:
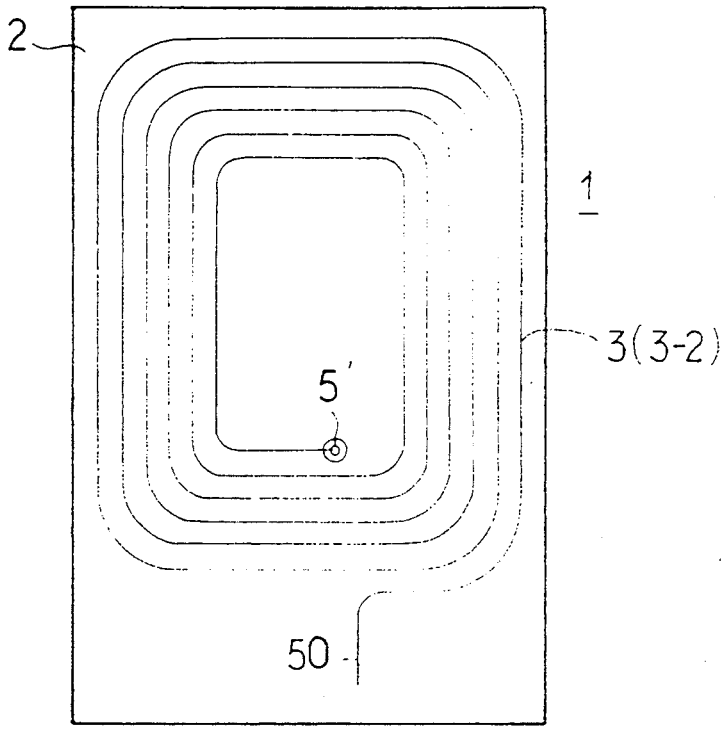

FIGS. 32, 33, 34 and 35 show still another modification of three-layer construction. This modification comprises stacked layers, i.e., an upper-layer which is a coil sheet (FIG. 33) having a conductor 3 corresponding to the first conductor 3-1, an intermediate-layer which is a coil sheet 1 (FIG. 34) having first and second conductors 3-1, 3-2 spirally wound in a direction opposite to the winding direction of the above conductor 3, and a lower layer which is a coil sheet 1 (FIG. 35) having a conductor 3 spirally wound in a specified direction and corresponding to the second conductor 3-2. The conductor 3 of the upper layer and the first conductor 3-1 of the intermediate layer provide a two-terminal series circuit. The second conductor 3-2 of the intermediate layer and the conductor 3 of the lower-layer provide another two-terminal series circuit,, The coil sheets of the upper and lower layers are those of the third type, and the coil sheet of the intermediate-layer is of the first type. The inner end of the conductor 3 of the upper-layer is connected to the, inner end of the first conductor 3-1 of the intermediate-layer via a plated through hole 4'. The inner end of the second conductor 3-2 of the intermediate layer is connected to the inner end of the conductor 3 of the lower layer via a plated through hole 5'. The outer end of the conductor of each layer extends into an external conduction line 40 or 50 on the corresponding layer. The conductors of the=intermediate and lower layers are illustrated in the same manner as above. The overall circuit construction of the conductors on the layers of the present modification is shown in FIG. 32 in the same manner as above.

Such coil sheets of the modification of FIGS. 32 to 35 are assembled or stacked up to form specified circuits.

The conductors of the present invention are in the form of the first and second conductors or conductors corresponding to these conductors. These conductors are usable to provide two winding systems (primary and secondary) and also three or more winding systems (including tertiary, quaternary and additional windings), i.e., multiplicity of winding systems.

The coil 10 of any of the types shown in FIG. 12 et. seq. and embodying the invention can be mounted on a ferrite or like core 8 as shown in FIGS. 12, 15, 18, 28 and 32 to make a transformer. In this case, holes (not shown) are formed in the insulators 2 or 21 for inserting the legs of the core 8 therethrough. FIGS. 12, 15, 18, 28 and 32 show a core member 8*a* in the form of a separate flat plate for use in combination with the core 8.

Figure 36:
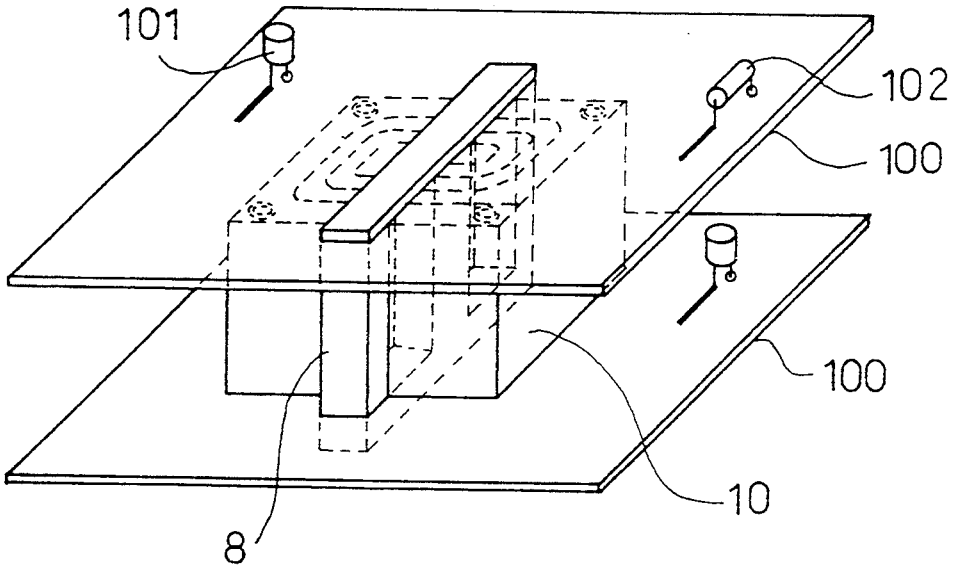
FIG. 36 is a perspective view of an embodiment in the coil of the invention is mounted between printed circuit boards.

The coil 10 may be mounted between printed circuit boards 100,100. This embodiment is illustrated in FIG. 36 in which a condenser is designated 101 and a resistor is designated 102.

We claim:

1. A device comprising a winding and at least one secondary winding, the primary winding and the secondary winding each having at least one coil element, each of the coil elements of each winding including a sheet insulator, a first conductor provided on one surface of the insulator in a planar spiral form and extending form the center of the insulator outwardly toward the periphery thereof and a second conductor provided on the other surface of the insulator in a planar spiral form and extending from the center of the insulator outwardly toward the periphery thereof, the conductors on the respective surfaces of the insulator being wound spirally in directions opposite to each other when seen from above at the same side of the insulator, each coil element of each winding having a through hole formed in the center of the coil element to connect the inner ends of the first and second conductors of the coil element to each other by means of the through holes, each sheet insulator of each winding having a peripheral pad at the periphery of each of the windings on its surfaces and having at least one peripheral through hole in the periphery thereof, each of the pads and peripheral through holes of each of the sheet insulators in each winding being in register, and each conductor end serving as an external terminal of each winding being connected to said peripheral through hole.

2. A device according to claim 1 wherein each of said windings comprises a plurality of said coil elements and wherein each conductor end serving as an intermediate terminal of each winding being connected to a pad.

* * * * *